US006991437B2

(12) United States Patent
Cherry et al.

(10) Patent No.: US 6,991,437 B2
(45) Date of Patent: Jan. 31, 2006

(54) AIR COMPRESSOR WITH IMPROVED HAND PORTABILITY

(75) Inventors: Richard Cherry, York, PA (US); John Buck, Cockeysville, MD (US); Mark J. Downes, Bel Air, MD (US); Nick E. Achterberg, Trappe, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/053,033

(22) Filed: Feb. 8, 2005

(65) Prior Publication Data

US 2005/0163625 A1 Jul. 28, 2005

Related U.S. Application Data

(63) Continuation-in-part of application No. 10/630,090, filed on Jul. 30, 2003, which is a continuation of application No. 10/154,416, filed on May 23, 2002, now abandoned, and a continuation-in-part of application No. 29/136,877, filed on Feb. 8, 2001, now Pat. No. Des. 461,196.

(60) Provisional application No. 60/366,676, filed on Mar. 22, 2002.

(51) Int. Cl.
*F04B 53/00* (2006.01)

(52) U.S. Cl. ..... 417/234

(58) Field of Classification Search ..... 417/234
See application file for complete search history.

(56) References Cited

U.S. PATENT DOCUMENTS 6,375,437 B1 * 4/2002 Nolan ..... 417/234
6,406,270 B1 * 6/2002 Kopel ..... 417/237

* cited by examiner

*Primary Examiner*—Charles G. Freay
(74) *Attorney, Agent, or Firm*—Harness, Dickey & Pierce, P.L.C.

(57) ABSTRACT

An air compressor package having improved stability and portability. The air compressor package is positionable in an operational position, wherein the air compressor package is positioned on a base, and a transport position, wherein the air compressor package may be more readily transported. Positioning of the air compressor package into the transport position is accomplished by rotating the air compressor about a rotational axis that is generally parallel to the longitudinal axis of the air tank. The air compressor package includes a protective stop configured to contact a support surface when the air compressor package is moved between the operating position and the transport position, thereby preventing slippage of the air compressor package away from the user.

17 Claims, 11 Drawing Sheets

AIR COMPRESSOR WITH IMPROVED HAND PORTABILITY

CROSS-REFERENCE TO RELATED APPLICATIONS

This application is a continuation-in-part of U.S. Ser. No. 10/630,090 filed Jul. 30, 2003, which is a continuation of U.S. Ser. No. 10/154,416 filed May 23, 2002 now abandoned . U.S. Ser. No. 10/154,416 claims the benefit of U.S. Provisional Application No. 60/366,676 filed Mar. 22, 2002 and is a continuation-in-part of U.S. application Ser. No. 29/136,877 filed Feb. 8, 2001. U.S. application Ser. No. 29/136,877 issued as U.S. Design Pat. No. D461,196 on Aug. 6, 2002.

FIELD OF THE INVENTION

The present invention generally relates generally to the field of portable air compressors and more particularly to hand portable air compressors with improved portability and ruggedness.

BACKGROUND OF THE INVENTION

Small air compressors have become common tools around the home, workshop and work site. For home, recreation and other light duty uses such as inflating sports or recreation equipment or for emergency use in inflating a car tire a number of very small and lightweight compressors are available. Such tasks require relatively low-pressure compressed air and/or relatively low airflow rates. Weight is kept low and portability is maximized in these designs by use of small, low volume and/or low-pressure compressors powered by small lightweight electric motors. Additionally, significant weight, size and cost savings are achieved by the omission of a high-pressure vessel (i.e., air tank), as well as an oil lubrication system.

Many jobs, however, require higher air pressures, and/or greater instantaneous air flow demands which typically exceed the capacity of the hobby or recreational use compressors. To satisfy the demands of higher air pressure and higher airflow tasks it is necessary to increase the size of the compressor and the related motor or engine. Furthermore, rather than sizing the compressor to meet the maximum theoretical instantaneous air flow demand, it is common design practice to include a compressed air reservoir in the form of an air tank or other pressure vessel. The tank, usually with an output regulator, can hold a quantity of pressurized air to meet peak demands from serviced loads, while allowing the use of a smaller and lighter compressor that charges the tank and is capable of meeting the average compressed air flow rate for the intended use.

The air tank and the larger compressor that are typically required to meet the desired pressure and airflow levels substantially increase the weight and overall size of the compressor package. Units designed for high pressure and high volume tasks can rapidly reach a weight and size where the well-known motor vehicle mounted or towed trailer configuration is the only practical form. Still, there are a range of intermediate capacity air compressors that are common tools around the construction site and which are man portable.

Current models of man portable air compressor packages comprise a stand or supporting structure on or in which are mounted a motor or engine, an air compressor, an air tank, a discharge manifold and various valves, instrumentation and controls. Many of the larger portable configurations are provided with wheels, in what is often referred to as a wheelbarrow configuration, so that they can be moved by a single user. Examples of wheeled air compressors include Models D55170 and D55270, which are marketed by DeWalt.

Still, some users of intermediate capacity professional grade compressors find it necessary or desirable to have a compressor that is capable of being lifted and carried by hand. One common approach taken by air compressor manufacturers to improve the portability of such intermediate capacity professional grade compressors has been to redesign the air compressor so as to reduce its weight. Despite such efforts, intermediate capacity professional grade compressors frequently weigh more than 50 pounds and thus remain difficult to lift and move by hand, even for those users who are physically strong.

Aside from the issue of their weight, hand-portable intermediate capacity professional grade compressors are also known to be quite cumbersome to transport. In this regard, the configurations that use two cylindrical tanks or a single pancake tank (i.e., a cylindrical tank of large diameter but small height with convex ends) have become common, as have the mounting schemes for mounting the compressor and the motor. For example, configurations that use two cylindrical tanks typically mount the compressor and motor alongside the tanks, whereas configurations that use a single pancake tank typically mount the compressor and motor on an end of the tank.

These conventional air compressor arrangements provide a package with a relatively large base or footprint, and a center of gravity that is positioned in an approximately centered position within the footprint. While such arrangements provide the air compressor with a configuration that is relatively stable during its operation, lifting and carrying air compressors with these configurations tends to be rather awkward and difficult. In this regard, these configurations typically employ a handle (for lifting and carrying the air compressor) that is attached to an appropriate structure, such as the stand or the air tank, at a location that is located vertically above the center of gravity of the entire air compressor package. The handle is generally oriented in a manner that requires the air compressor package to be lifted vertically upwards and carried in an orientation that is substantially the same as the orientation in which it is operated.

Lifting and carrying the known intermediate air compressor packages in this manner, however, is relatively difficult, since the footprint of these air compressor packages tends to be relatively large and thus requires the user to hold the air compressor package with a somewhat outstretched arm such that the wrist of the user is in a state of flexion. In an effort to bring the air compressor package's center of gravity closer to the central axis of the user, the user will typically tilt their upper body away from the load of the air compressor package and thus will lift and transport the air compressor package with a body posture that is uncomfortable and awkward.

SUMMARY OF THE INVENTION

In one form, an air compressor is provided with improved portability. The air compressor includes a compressor, a support structure and at least one air tank in fluid connection with the compressor. A handle extends outwardly from a side of the compressor assembly and is configured to be grasped by a hand of a user so that the air compressor can be rotated about a horizontal axis between an operating position and a hand-carried transport position. The air compressor further includes at least one protective stop configured to contact a surface which supports the compressor assembly in the operating position when the compressor assembly is moved between the operating position and the transport position.

In another form, the air compressor may include two laterally spaced apart air tanks; a compressor disposed between the two air tanks and in fluid connection with each of the air tanks; and two inverted unshaped tubular members extending upwardly from the two air tanks, where the two u-shaped tubular members are laterally spaced apart such that the compressor is disposed substantially within a volume defined by the u-shaped tubular members and the air tanks. The air compressor further includes a handle projecting outwardly in a horizontal direction away from the compressor; and at least one rubber member affixed to an outwardly facing surface of the air tank disposed opposite the handle, such that the rubber member prevents slippage of the air compressor assembly away from the user when the compressor assembly is moved between the operating position and the transport position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE PREFERRED EMBODIMENTS

Figure 1:
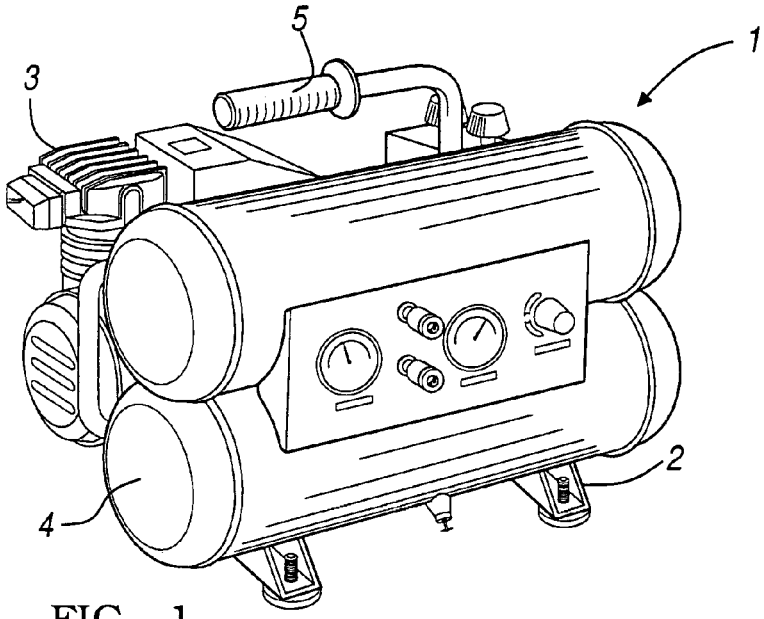
FIG. 1 (PRIOR ART)
FIG. 1 is a perspective view of a compressor package constructed in accordance with the teachings of the prior art.
Figure 2:
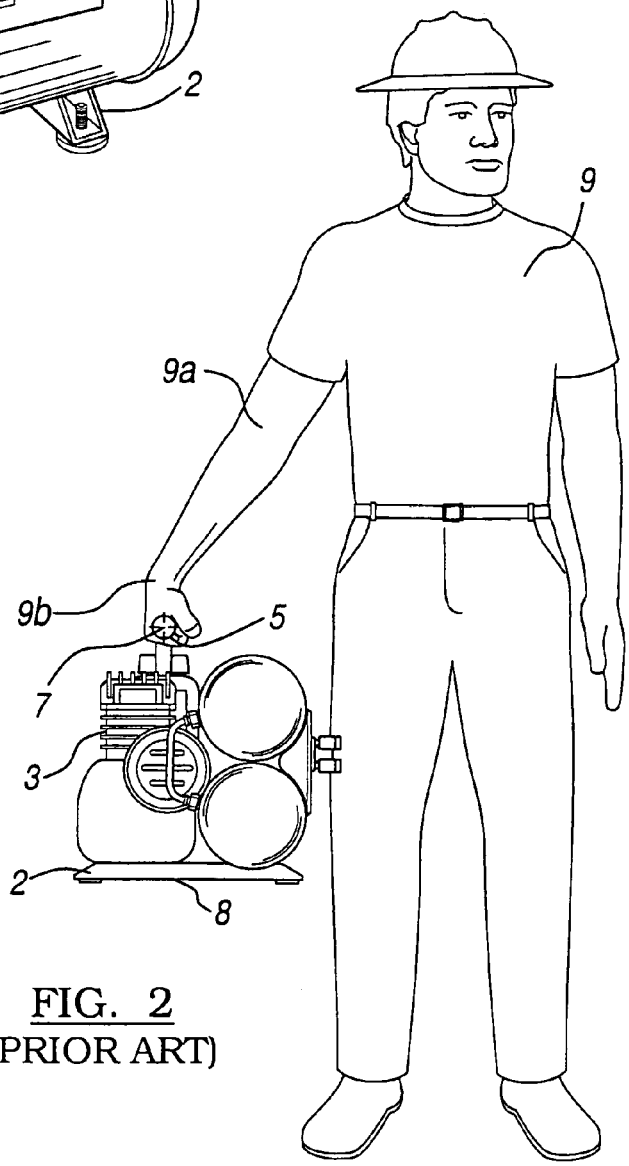
FIG. 2 (PRIOR ART)
FIG. 2 is a front view of a user transporting the compressor package of FIG. 1.

With reference to FIGS. 1 and 2 of the drawings, a prior art air compressor package 1 is illustrated to include a support structure 2, a compressor mechanism 3, an air tank 4 and a handle 5. The compressor mechanism 3 and the air tank 4, which are among the heavier components of the air compressor package 1, are distributed horizontally about the support structure 2 such that the center of gravity 6 of the air compressor package 1 is disposed well within the interior of an area bounded by the support structure 2. The handle 5 is coupled to the support structure 2 in a manner that places a centerline 7 of the handle 5 vertically in-line with the center of gravity 6 of the air compressor package 1.

With additional reference to FIG. 2, the configuration of the handle 5 is such that it permits the air compressor package 1 to be lifted vertically and transported in the same orientation as it is operated. The size of the footprint or base 8 of the air compressor package 1, however, is relatively large, which necessitates that the user 9 transport the air compressor package 1 with a somewhat outstretched arm 9*a*. Consequently, the user's wrist 9*b* is maintained in a state of flexion, which tends to be uncomfortable for the user and fatiguing.

Figure 3:
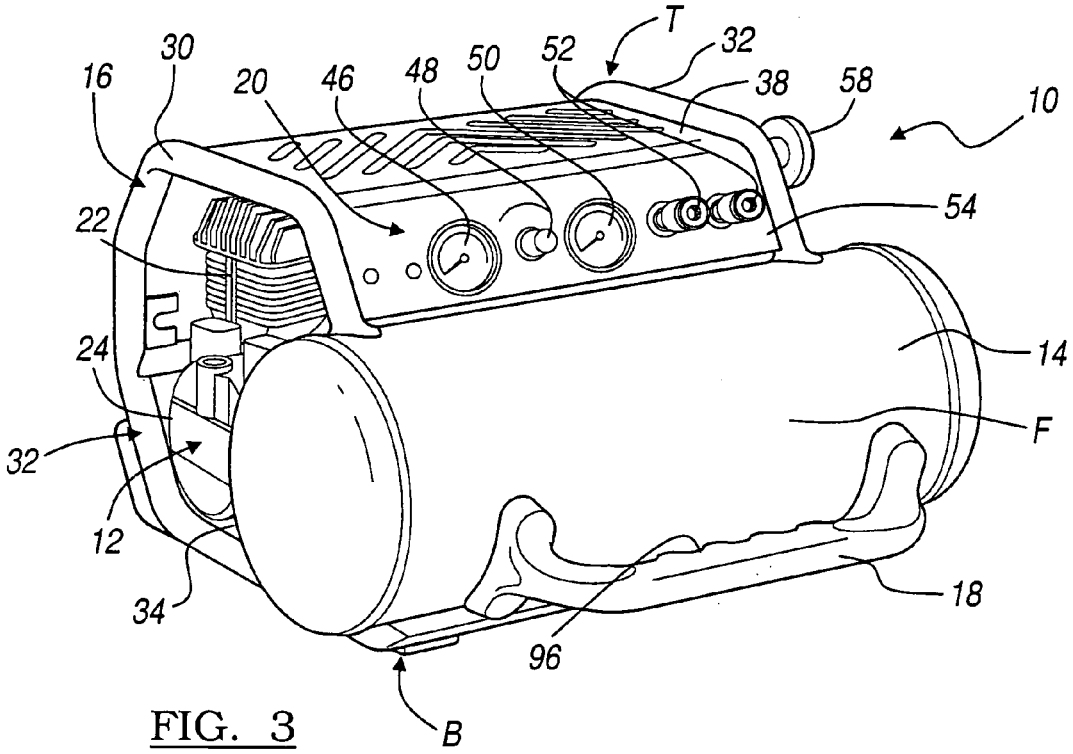
FIG. 3 is a perspective view of an air compressor package constructed in accordance with the teachings of the present invention.
Figure 4:
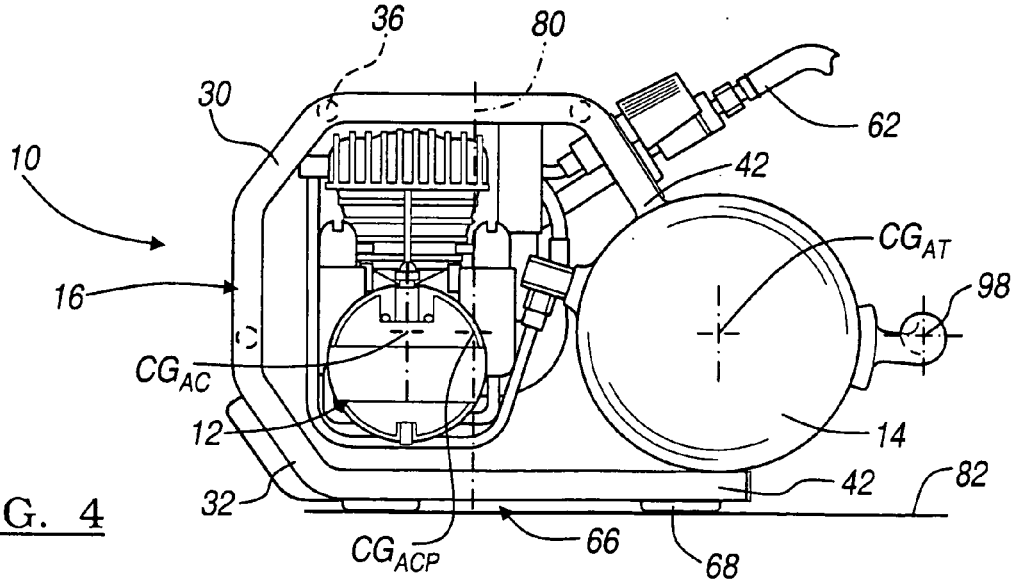
FIG. 4 is a left side elevational view of the air compressor package of FIG. 3 as positioned in an operational position.
Figure 5:
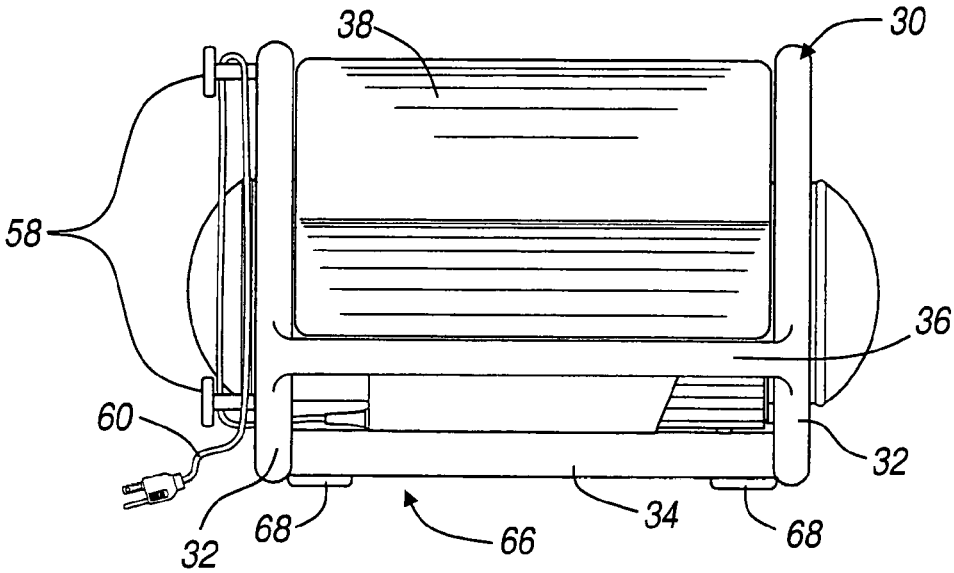
FIG. 5 is a rear elevational view of the air compressor package of FIG. 3.

In FIGS. 3 through 5, an air compressor package constructed in accordance with the teachings of the present invention is generally indicated by reference numeral 10. The air compressor package 10 is illustrated to include a compressor mechanism 12, an air tank 14, a support structure 16, a handle 18 and a gauge package 20. The compressor mechanism 12 is conventional in its construction and operation and as such, need not be discussed in detail herein. Briefly, the compressor mechanism 12 includes a compressor 22, which is operable for intaking and compressing ambient air, and a power source, such as an electric motor 24 or an engine, for providing power to the compressor 22. The compressed air that exits the compressor 22 is discharged to the air tank 14, which serves as a reservoir for the compressed air.

The air tank 14 has a capacity of at least 0.5 gallons and in the particular example provided, is illustrated as having a single cylindrically shaped tank structure. The air tank 14, however, preferably has a capacity of about 1 to about 8 gallons, and more preferably a capacity of about 3 to about 5 gallons. Those skilled in the art will understand that the air tank 14 may be configured somewhat differently, as with a conventional pancake-style (i.e., a relatively short and large diameter cylinder with convex ends) tank structure (not shown) or with a plurality of cylindrically shaped tank structures that are coupled in fluid connection.

The support structure 16 is illustrated to be configured in a "roll-cage" manner that extends around both the compressor mechanism 12 and the gauge package 20 to protect these components should the air compressor package 10 be overturned or impacted by another object. In the particular embodiment illustrated, the support structure 16 includes a tubular frame 30 having opposite laterally extending sides 32 that are interconnected by a mounting platform 34 and a plurality of strut members 36, as well as an optional shield or cover 38. In the example provided, the cover 38 is formed from a sheet material, such as steel, aluminum or plastic, and is removably fastened with, for example, conventional threaded fasteners (not shown) to the tubular frame 30. While the primary purpose of the cover 38 is to protect components such as the compressor mechanism 12 and the gauge package 20 from damaging contact with, for example, falling tools and workpieces, those skilled in the art will understand that the relatively smooth outer surface of the cover 38, when abutted against the lateral side of the user during transport, is relatively more comfortable and less likely to interfere with the movement of the user as compared to the tubular frame 30, the compressor mechanism, the air tank 14 and/or the gauge package 20.

In the example provided, the laterally extending sides 32 are constructed in an open manner, such that the ends 42 of the laterally extending sides 32 do not intersect one another but rather intersect the air tank 14. The ends 42 are coupled to the air tank 14 through a conventional coupling means, such as welds. In the particular embodiment illustrated, the air tank 14 extends through the laterally extending sides 32 but those skilled in the art will understand that the air tank 14 could alternatively be configured to terminate flush or inboard of the laterally extending sides 32 so that the support structure 16 would also protect the opposite ends of the air tank 14. The gauge package 20, which conventionally includes an air tank pressure gauge 46, a regulator 48, a regulator gauge 50 and an outlet manifold 52, is coupled to a gauge panel 54 that is mounted between the laterally extending sides 32 of the support structure 16. The gauge panel 54 may be a discrete component or may be integrally formed with the cover 38. Preferably, the gauge panel 54 is mounted in a rearwardly sloped orientation, which is best illustrated in FIGS. 3 and 4, as opposed to the substantially vertical orientation that is illustrated in the prior art air compressor package 1 of FIG. 1, so as to position the air tank pressure gauge 46, the regulator 48, the regulator gauge 50 and the outlet manifold 52 in a manner that is relatively more comfortable for the user of the air compressor package 10 to read and/or access. As those skilled in the art will appreciate from this disclosure, the improved readability of the air tank pressure gauge 46 and the regulator gauge 50 and the improved accessibility of the regulator 48 that result from the positioning of the gauge panel 54 in a rearwardly sloped orientation improves the accuracy with which the user is able to control the air pressure that is delivered to the outlet manifold 52. Pegs 58, which are coupled to one of the laterally extending sides 32 and extend outwardly therefrom, are optionally provided so as to permit items, such as a power cord 60 or an air hose 62, to be coiled (around the pegs 58) for storage.

Figure 6:
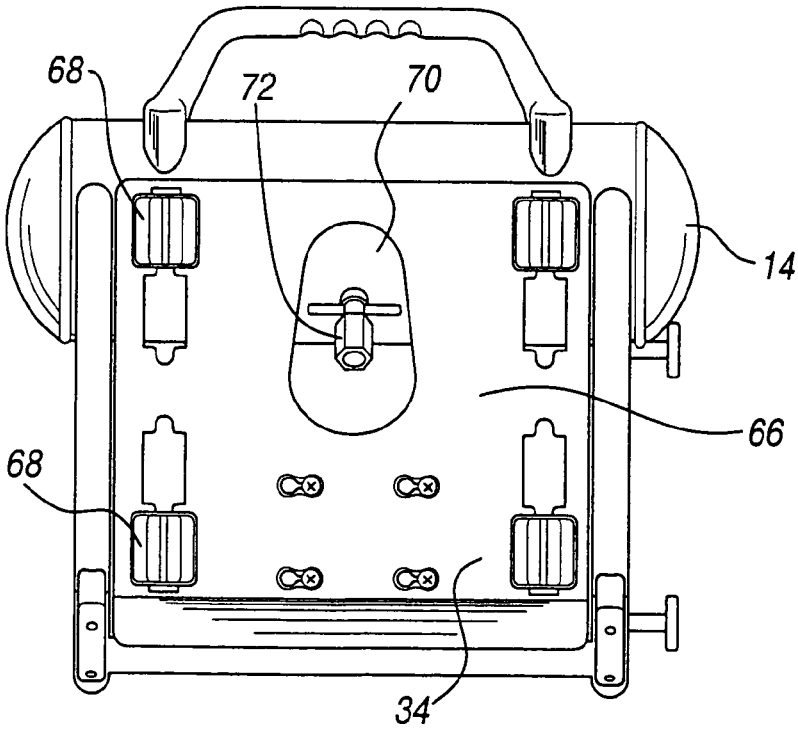
FIG. 6 is a bottom plan view of the air compressor package of FIG. 3.

The mounting platform 34, which is illustrated to be fabricated from a sheet material, such as steel, aluminum or plastic, serves as the base 66 of the support structure 16. The compressor mechanism 12 is coupled to the mounting platform 34 via a plurality of threaded fasteners (not specifically shown). A plurality of rubber feet 68 are affixed to the corners of the mounting platform 34 and serve to dampen vibrations that are transmitted through the support structure 16 as well as to provide the support structure 16 with a degree of skid resistance. With specific reference to FIG. 6, an access aperture 70 is formed through the mounting platform 34 and permits the user to access a valve mechanism 72 to manually drain the air tank 14.

With renewed reference to FIG. 4, those skilled in the art will appreciate that the air tank 14 and the compressor mechanism 12 are coupled to the support structure 16 such that their centers of gravity, $CG_{AT}$ and $CG_{AC}$, respectively, are positioned relatively close to the base 66 when the air compressor package 10 is oriented in its operational position (FIGS. 3 through 5). As the air tank 14 and the compressor mechanism 12 account for a majority of the weight of the air compressor package 10, configuration in this manner is advantageous in that it provides the air compressor package 10 with a relatively low center of gravity $CG_{ACP}$. As those skilled in the art will understand, the center of gravity $CG_{ACP}$ acts along a plane 80 that is skewed to the base 66. In the particular embodiment illustrated, the plane 80 is substantially perpendicular to the base 66 since the base 66 is situated on a flat surface 82, such as a floor.

With reference to FIGS. 3 and 7, the handle 18 is configured to be gripped by a palmar surface 90 of the hand 92 of a user 94 when the user 94 is transporting the air compressor package 10. The handle 18 may be of any type and may be mounted to any appropriate structure, such as the support structure 16 or the air tank 14. In the particular embodiment illustrated, the handle 18 is fixedly mounted to air tank 14 and includes a grip portion 96 that is contoured to receive the fingers of the user when the user is transporting the air compressor package 10. The grip portion 96 is formed about a centerline 98 that lies in (or is positionable into) a plane 100 that includes the center of gravity $CG_{ACP}$ of the air compressor package 10.

Figure 7A:
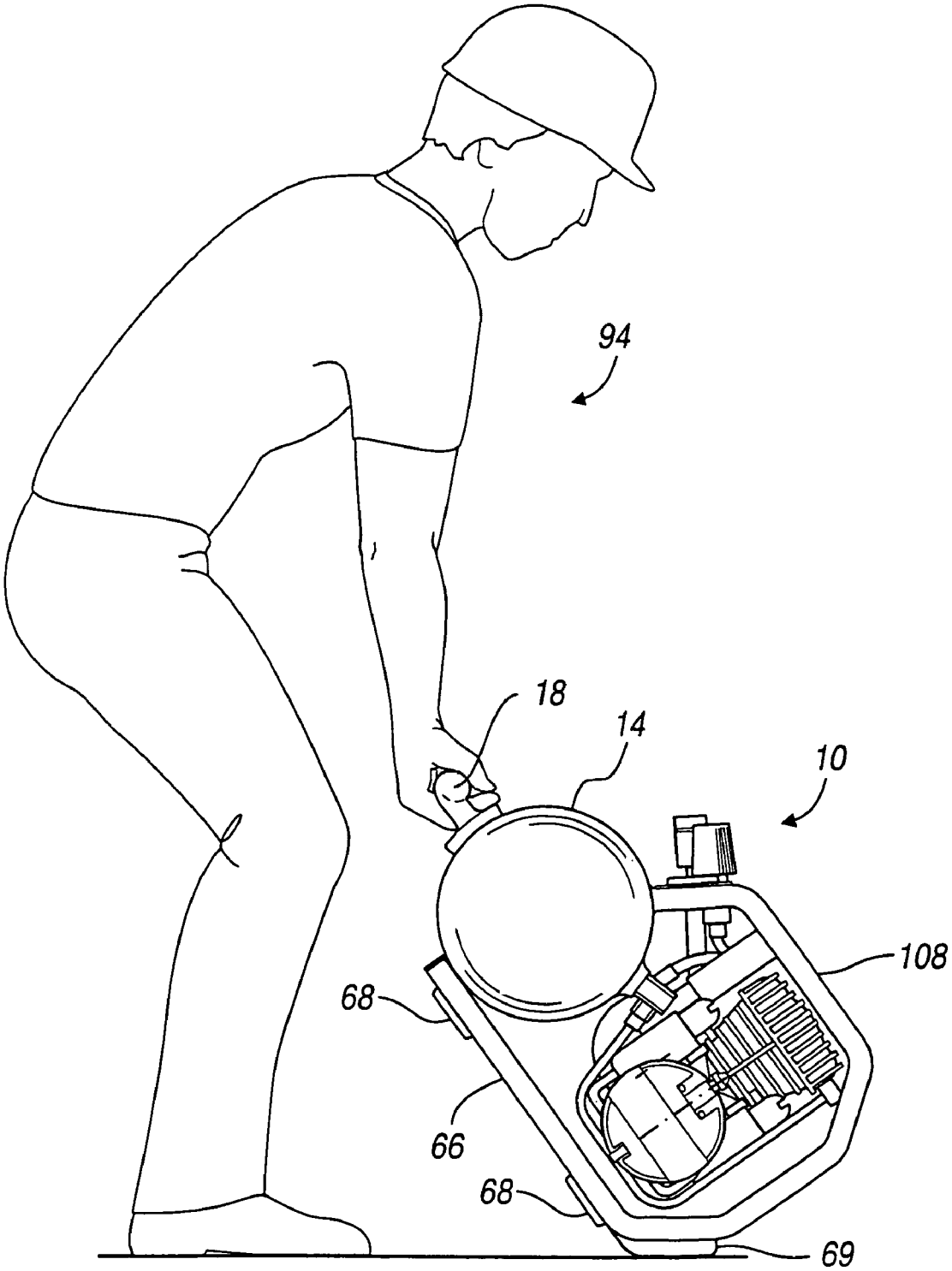
FIGS. 7A and 7B are left side elevational views of the air compressor package of FIG. 3 as its being rotated to and positioned in a transport position, respectively.
Figure 7B:
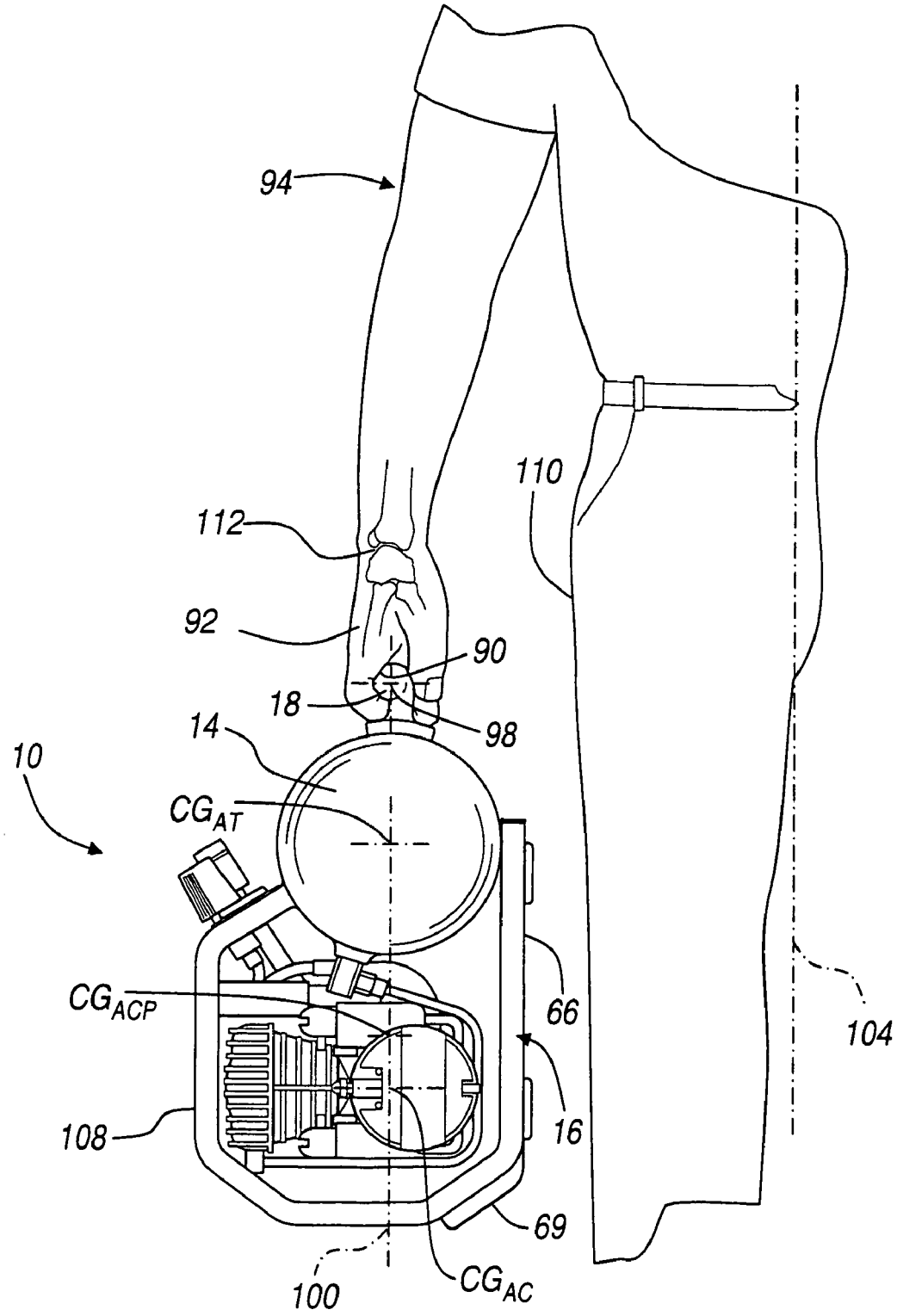

The handle 18 permits the user of the air compressor package 10 to reposition the air compressor package 10 from the operational position that is illustrated in FIG. 4 to a transport position that is illustrated in FIG. 7A. To facilitate repositioning of the air compressor package 10 in this manner, a protective stop 69 may be fastened with, for example, conventional threaded fasteners (not shown) to each of the laterally extending sides 32 of the tubular frame 30. The protective stops 69 are preferably comprised of rubber or some other type of material having an adhesive characteristic. In some instances, the user may roll air compressor package onto its side as shown in FIG. 7B. In these instances, the protective stops 69 prevent any unwanted slippage of the air compressor package away from the user.

When positioned in the transport position, the plane 100 that includes the centerline 98 of the handle 18 and the center of gravity $CG_{ACP}$ of the air compressor package 10 is located in a substantially vertical orientation that is generally parallel to a vertical (longitudinal) axis 104 of the user 94, as well as generally parallel to the base 66 and the top 108 of the air compressor package 10.

Furthermore, since the center of gravity $CG_{ACP}$ of the air compressor package 10 is relatively close to the base 66 when the air compressor package 10 is oriented in the operational position, the user 94 is able to transport the air compressor package 10 such that the base 66 is proximate a lateral side 110 of the user 94 (i.e., within about 10 inches of the lateral side 110, and preferably about 3 inches to about 7 inches) and the user's wrist 112 is not in a state of flexion. When placed in the transport position, the air compressor package 10 is preferably configured such that the centers of gravity $CG_{AT}$ and $CG_{AC}$ of the air tank 14 and the compressor mechanism 12 are disposed in the plane 100, or oppositely offset therefrom by substantially equal distances. With the handle 18 thus positioned, the user 94 is able to comfortably carry the air compressor package 10, as well as to easily pivot the air compressor package 10 between the operational position and the transport position without releasing the handle 18.

Figure 8:
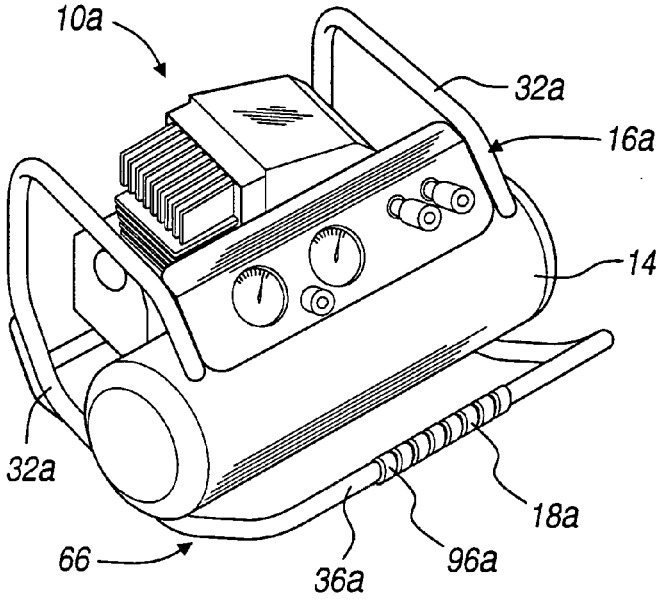
FIG. 8 is a perspective view of an air compressor package constructed in accordance with the teachings of an alternate embodiment of the present invention.
Figure 9:
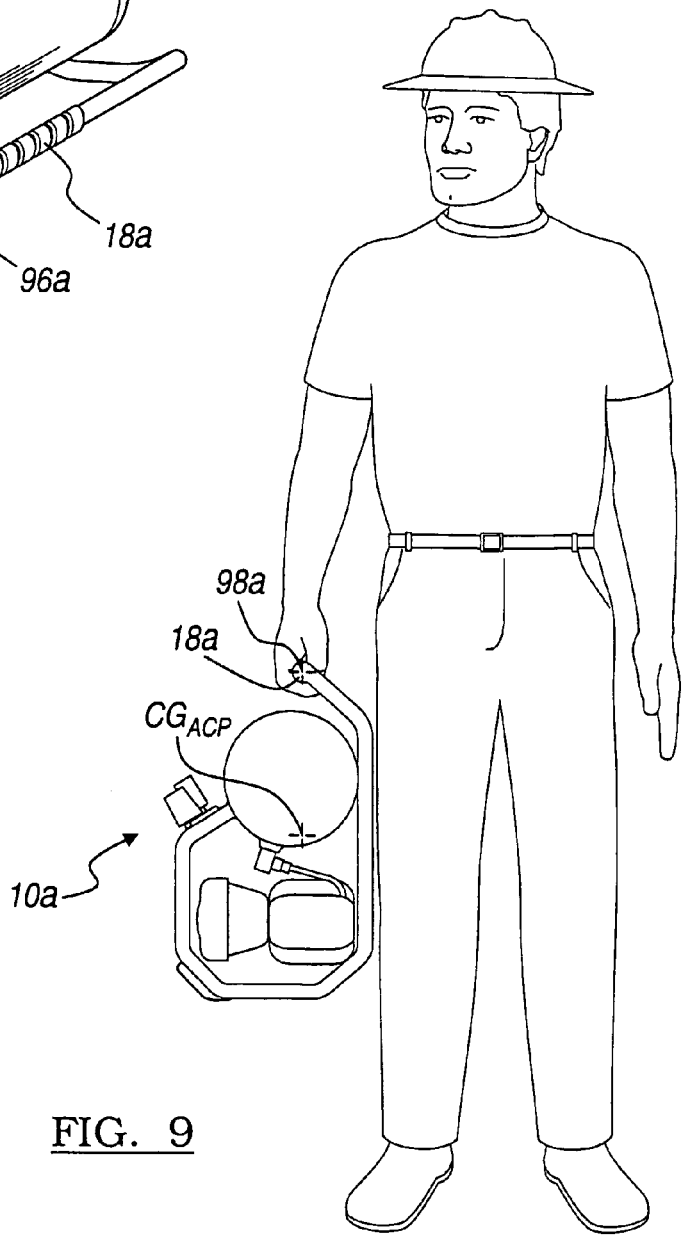
FIG. 9 is a left side elevational view of the air compressor package of FIG. 8 as positioned in a transport position.
Figure 10:
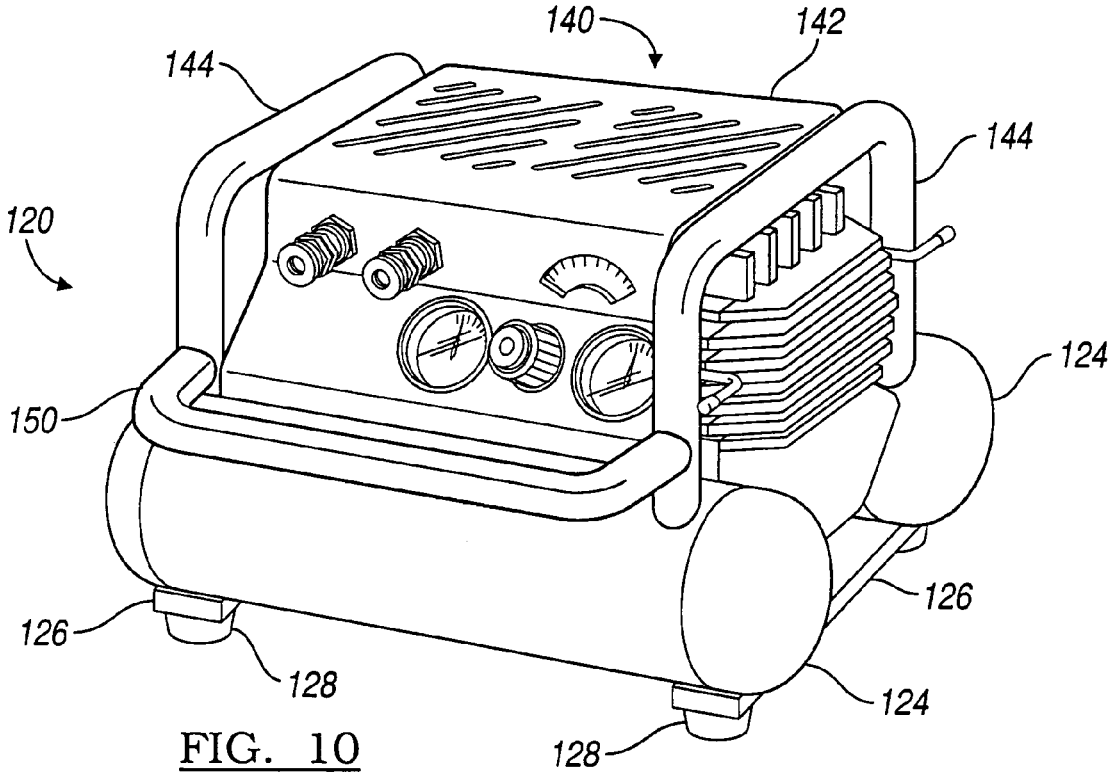
FIG. 10 is a perspective view of an air compressor package constructed in accordance with the teachings of another alternate embodiment of the present invention.
Figure 11:
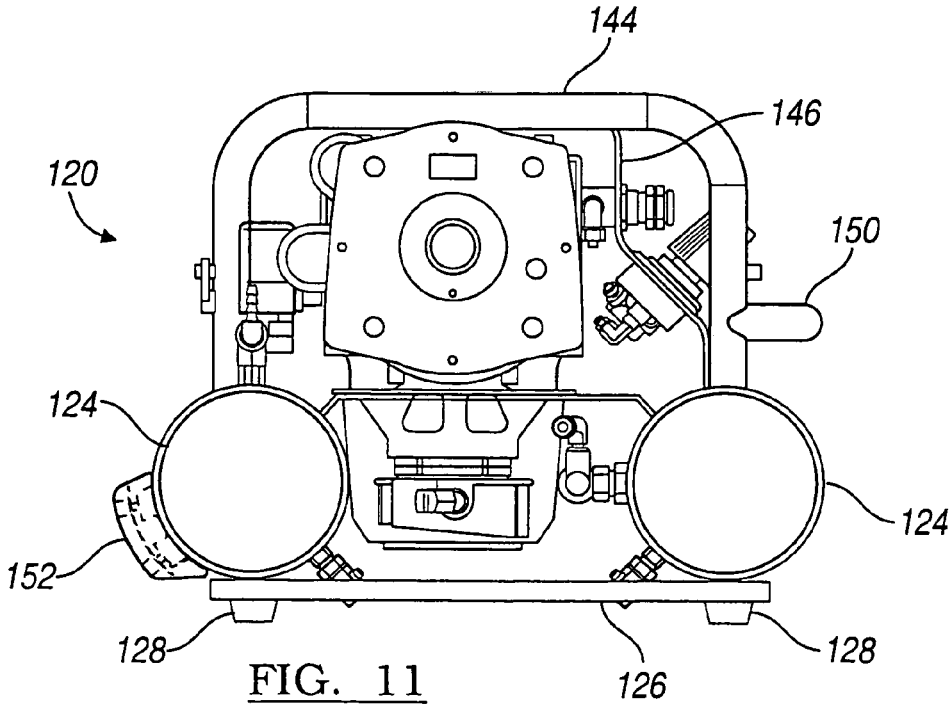
FIG. 11 is a left side elevational view of the air compressor package of FIG. 10 as positioned in an operational position.
Figure 12:
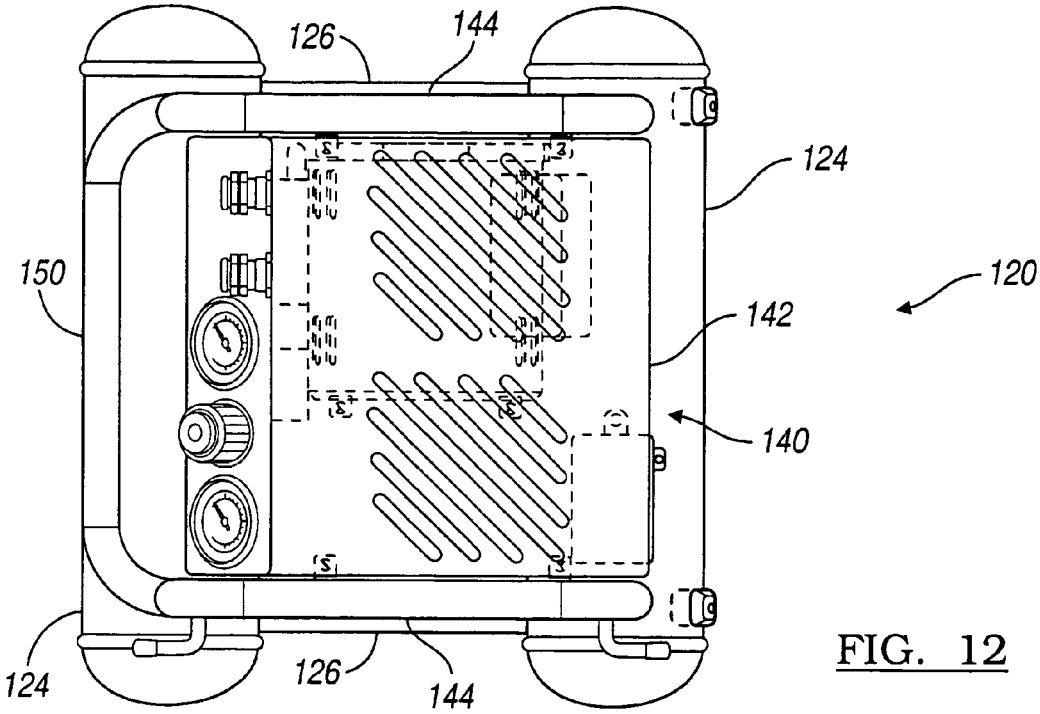
FIG. 12 is a top plan view of the air compressor package of FIG. 10.
Figure 13:
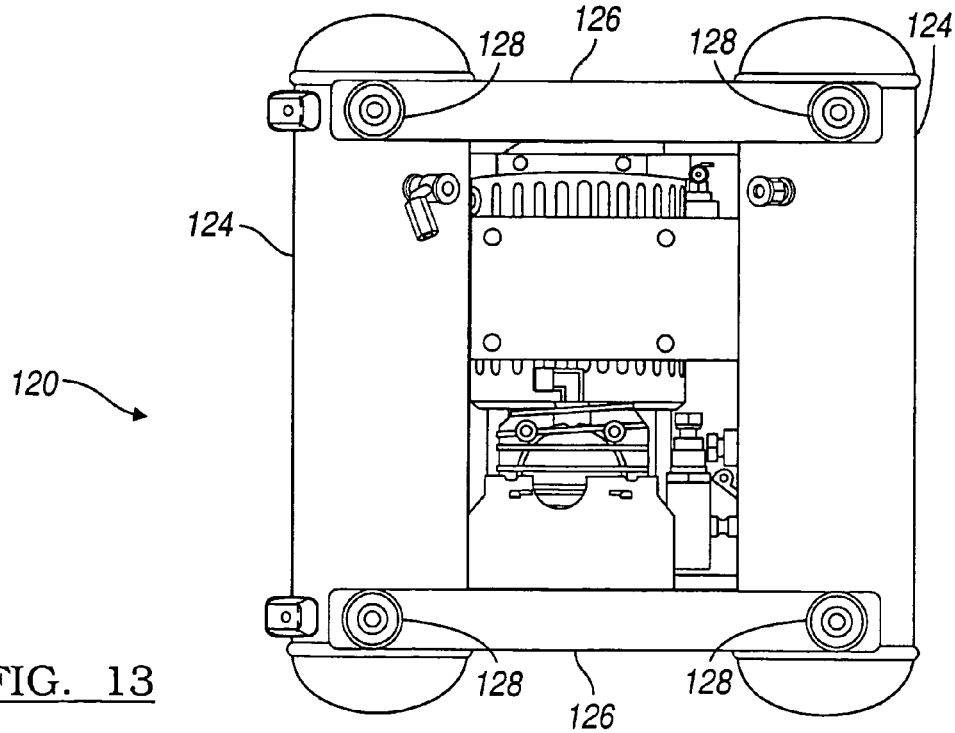
FIG. 13 is a bottom plan view of the air compressor package of FIG. 10.

While the air compressor package 10 has been described thus far as including an air tank 14 with a single cylindrically shaped tank structure and a handle 18 that is fixedly coupled to the air tank 14, those skilled in the art will appreciate that the invention, in its broader aspects, may be constructed somewhat differently. For example, the handle 18*a* may be incorporated into the support structure 16*a* as illustrated in FIGS. 8 and 9. In this embodiment, the support structure 16 extends around the air tank 14 on a side opposite the compressor mechanism 12 and upwardly from the base 66. A grip structure 96*a* is formed on the front strut member 36*a* that interconnects the opposite laterally extending sides 32*a*. Like the handle 18 of the air compressor package 10 that is illustrated in FIG. 3, the handle 18*a* is positioned such that a centerline 98*a* of the grip structure 96*a* is positioned in a plane that contains the center of gravity $CG_{ACP}$ of the air compressor package 10*a* when the air compressor package 10*a* is positioned in the transport position.

An alternative arrangement for an air compressor package 120 constructed in accordance with the teaching of the present invention is depicted in FIGS. 10–14. In this embodiment, an air compressor mechanism 122 is mounted between a pair of cylindrically shaped air tanks 124. As shown, the air tanks are spaced apart laterally from each other and supported on the underside by a pair of skid bars 126. The skid bars 126 are likewise spaced apart laterally from each other, but mounted transversely to the two air tanks 124. A rubber foot 128 is affixed to each end of each skid bar 126. These rubber feet 128 serve to dampen vibrations that are transmitted through the support structure during operation as well as provide a degree of skid resistance when placed in an operational position.

As described above, the air compressor mechanism 122 further comprises a compressor 132 operable to intake and compress ambient air and a power source 134, such as an electric motor or an engine, for providing power to the compressor. The compressor mechanism is again of a conventional construction and operation and as such does not need to be described in further detail.

A shroud assembly 140 protects the compressor mechanism and associated components should the air compressor package 120 be overturned or impacted by another object. In an exemplary embodiment, the shroud assembly 140 includes a protective plate 142 extending between a pair of inverted u-shaped tubular members 144. Ends of the tubular members 144 are coupled by conventional means, such as welds, to the top surface of the air tanks 124. The protective plate is in turn coupled to the tubular members 144. The protective plate is formed from a sheet or material, such as steel, aluminum, plastic or other suitable material, and is removably fastened with, for example, conventional threaded fasteners to the tubular frame.

A portion of the protective plate serves as a gauge panel 146 which supports conventional compressor accessory components, such as pressure gauges, a pressure regulator and one or more outlet manifolds. The gauge panel 146 is preferably sloped rearwardly in a manner that improves readability and accessibility of the gauges housed in the panel.

Figure 15A:
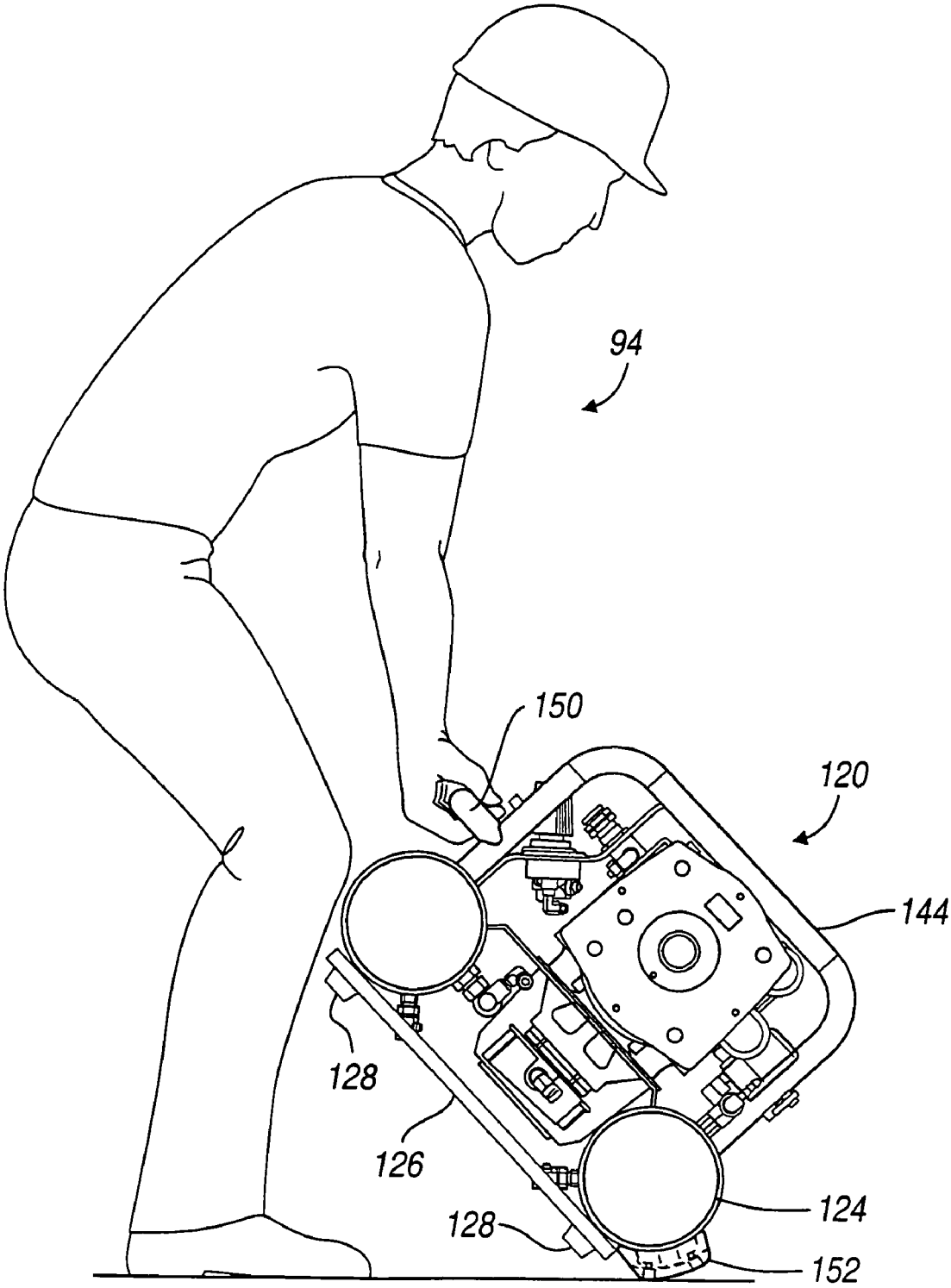
FIGS. 15A and 15B are left side elevational views of the air compressor package of FIG. 10 as its being rotated to and positioned in a transport position, respectively.
Figure 15B:
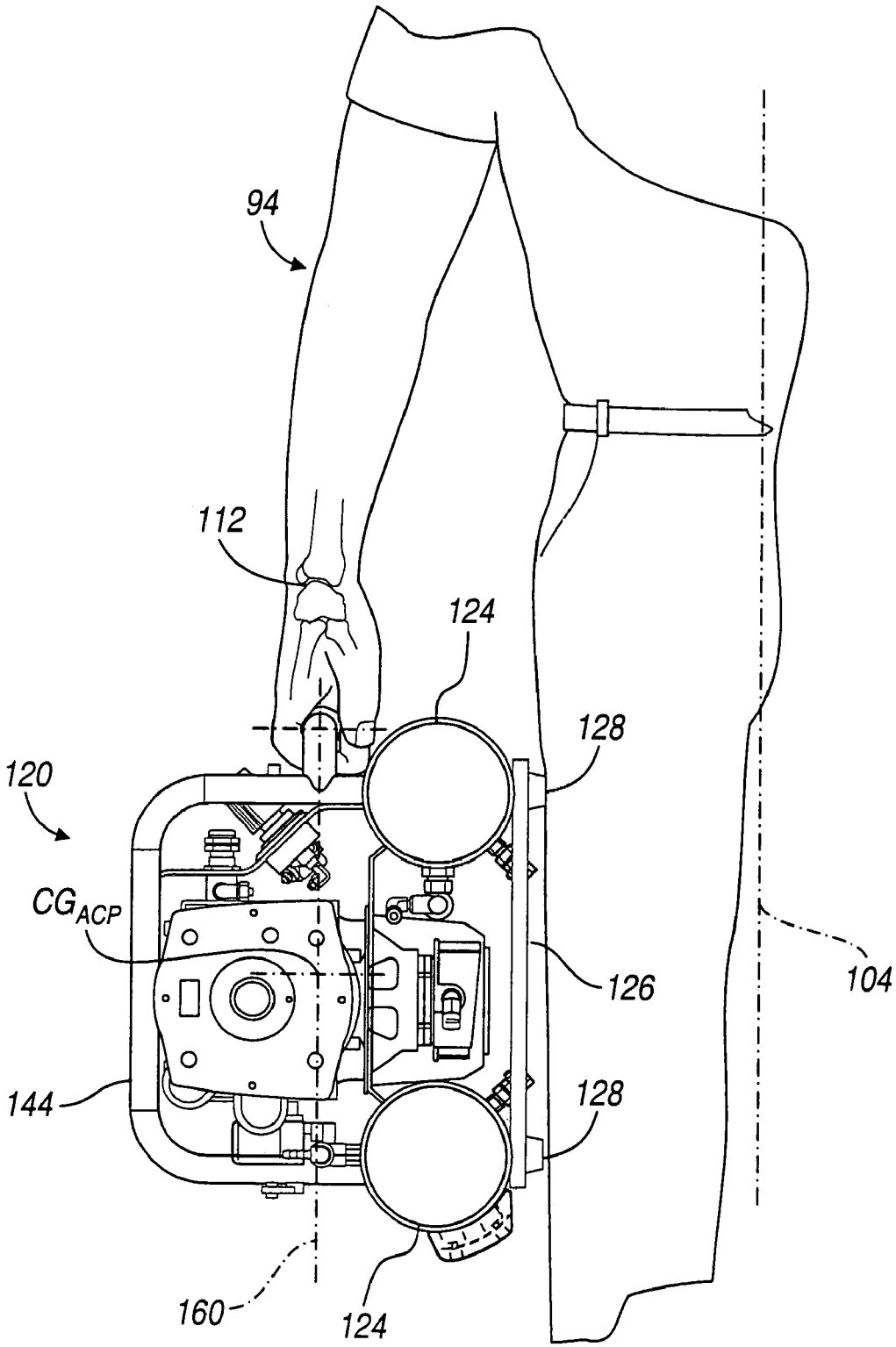

To transport the air compressor package 120, a handle extends outwardly from either side of the air compressor package 120. In the exemplary embodiment, the handle 150 is a tubular member which extends between the two u-shaped tubular members 144. It is contemplated that the handle 150 may include a grip portion that is contoured to receive the user's fingers. It is also contemplated that the handle may have other configurations and be mounted to other appropriate support structure, such as one of the air tanks. Again, the grip portion is preferably formed about a centerline that lies in (or is positionable into) a plane that includes the center of gravity $CG_{ACP}$ of the air compressor package 120. The handle 150 enables the user to rotate the air compressor package 120 to an intermediate position as shown in FIG. 15A prior to reaching a transport position as shown in FIG. 15B.

Figure 14A:
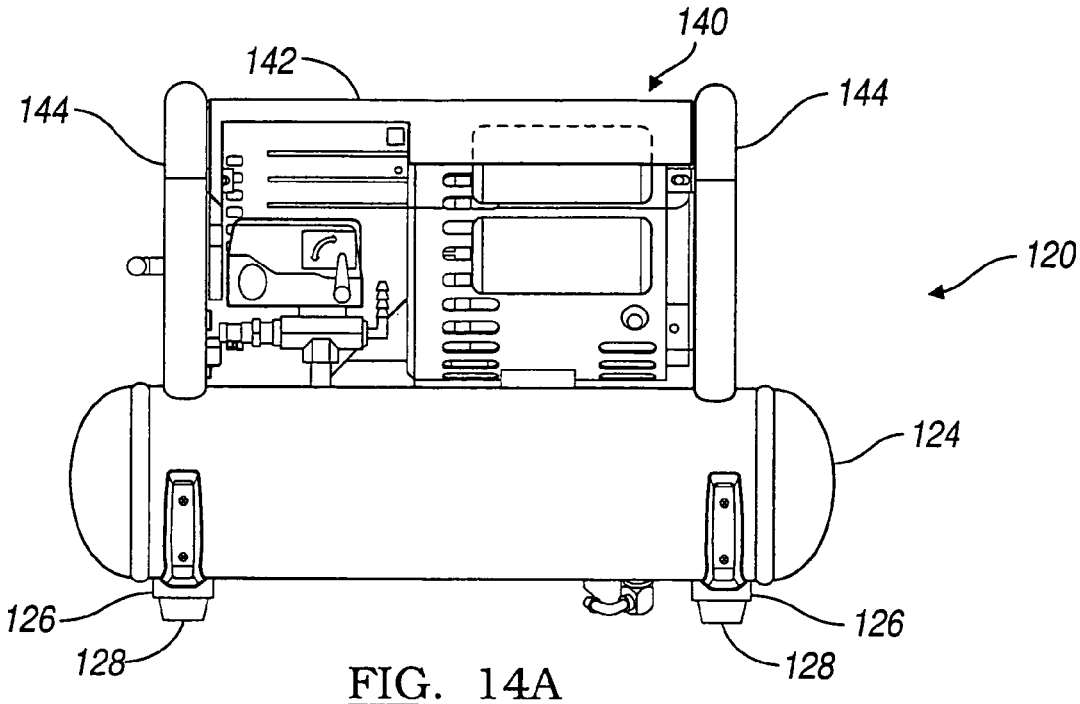
FIG. 14 is a rear elevational view of the air compressor package of FIG. 10.
Figure 14B:
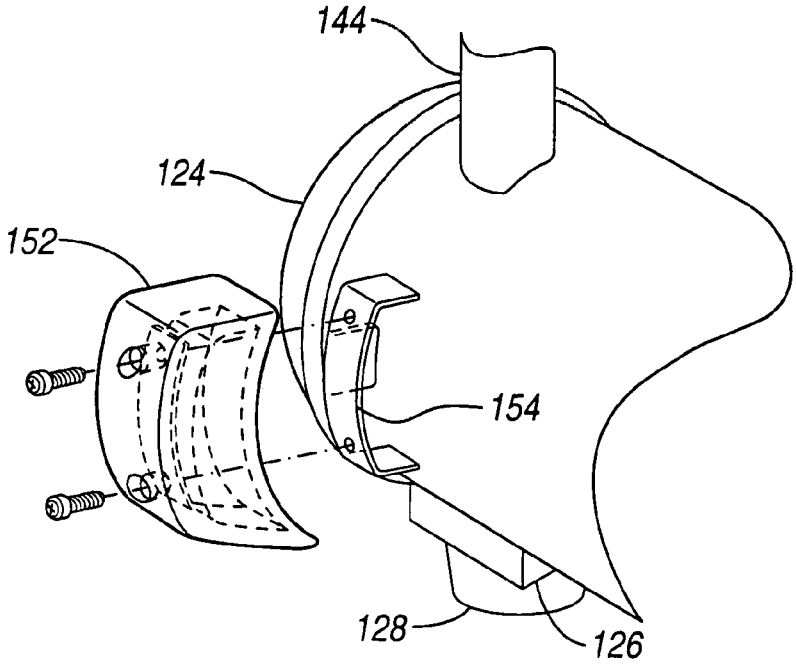

Protective stops 152 are again used to prevent any unwanted slippage of the air compressor package away from the user. In this embodiment, the protective stops 152 are fastened to the air tank disposed on an opposite side from the handle 150. More specifically, the protective stops 152 are fastened to a mounting bracket 154 which in turn is coupled to the air tank by conventional means, such as welds, as best seen in FIG. 14B. The protective stops 69 are preferably comprised of rubber or some other type of material having an adhesive characteristic. The protective stops 152 also protect the air tank from the rough surface and/or abrupt landings which may be encountered as the air compressor package is returned to an operational position.

When positioned in the transport position, the plane 160 that includes the centerline 162 of the handle 150 and a center of gravity $CG_{ACP}$ of the air compressor package 120 is located in a substantially vertical orientation that is generally parallel to a vertical (longitudinal) axis 104 of the user 94, as well as generally parallel to a base and a top 108 of the air compressor package 120. Furthermore, since the center of gravity $CG_{ACP}$ of the air compressor package 120 is relatively close to the base when the air compressor package 120 is oriented in the operational position, the user 94 is able to transport the air compressor package 120 such that the base is proximate a lateral side 110 of the user 94 (i.e., within about 10 inches of the lateral side 110, and preferably about 3 inches to about 7 inches) and the user's wrist 112 is not in a state of flexion. With the handle 150 thus positioned, the user 94 is able to comfortably carry the air compressor package 120, as well as to easily pivot the air compressor package 120 between the operational position and the transport position without releasing the handle 150.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. An air compressor comprising:

a compressor assembly having a support structure, a compressor, and at least one air tank in fluid connection with the compressor, the at least one air tank having a longitudinal axis and a capacity that is greater than about 0.5 gallons;

a handle extending outwardly from a side of the compressor assembly and orientated generally parallel to the longitudinal axis of the air tank, the handle being configured to be grasped by a hand of a user so that the air compressor can be rotated about a horizontal axis between an operating position and a hand-carried transport position; and at least one protective stop disposed on an opposite side of the compressor assembly and configured to contact a surface which supports the compressor assembly in the operating position when the compressor assembly is moved between the operating position and the transport position, wherein the protective stop is further defined as a rubber member operable to prevent slippage of the air compressor assembly away from the user when the compressor assembly is moved between the operating position and the transport position.

2. The air compressor of claim 1 wherein a center of the handle is positioned in a vertical plane when the air compressor assembly is positioned in the transport position, the vertical plane extending substantially through a center of gravity ($CG_{ACP}$) of the air compressor assmebly.

3. The air compressor of claim 2 wherein the handle is positioned such that when the air compressor assembly is positioned in the transport position and a user is transporting the air compressor assembly, the handle is grasped by the hand of a user such that a wrist associated with the hand of the user is not positioned in a state of flexion.

4. The air compressor of claim 3 wherein the handle is positioned within about 10 inches of the lateral side of the user when the air compressor assembly is positioned in the transport position, the handle is grasped by the hand of the user and the air compressor assembly is being transported by the user.

5. The air compressor of claim 4 wherein the handle is positioned within about 3 inches to about 7 inches of the lateral side of the user when the air compressor assembly is positioned in the transport position, the handle grasped by the hand of the user and the air compressor assembly is being transported by the user.

6. The air compressor of claim 1 wherein the compressor is disposed adjacent a cylindrically shaped air tank and the handle is coupled to the air tank wherein the compressor body includes a support cage.

7. The air compressor of claim 6 wherein the support structure is further defined as a tubular frame having a pair of laterally spaced-apart side members, wherein the compressor is substantially disposed within a volume defined by the laterally spaced apart side members and the air tank is partially disposed within the volume.

8. The air compressor of claim 1 wherein the compressor is disposed between two laterally spaced-apart air tanks and the support structure is further defined as two inverted and laterally spaced apart u-shaped tubular members extending upwardly from the two air tanks, such that the compressor is disposed substantially within a volume defined by the u-shaped tubular members and the air tanks.

9. The air compressor of claim 8 wherein the handle projects outwardly in a horizontal direction away from the compressor assembly and extending between the two u-shaped tubular members in a direction generally parallel to longitudinal axes of the two air tanks.

10. An air compressor comprising:

a compressor assembly having a support structure, a compressor, and two laterally spaced apart air tanks in fluid connection with the compressor, such that the compressor is disposed between the two air tanks;

a handle extending outwardly from a side of the compressor assembly and configured to be grasped by a hand of a user so that the air compressor can be rotated about a horizontal axis between an operating position and a hand-carried transport position; and at least one protective stop disposed on an opposite side of the compressor assembly and configured to contact a surface which supports the compressor assembly in the operating position when the compressor assembly is moved between the operating position and the transport position.

11. The air compressor of claim 10 wherein the protective stop is further defined as a rubber member which prevents slippage of the air compressor assembly away from the user when the compressor assembly is moved between the operating position and the transport position.

12. The air compressor of claim 10 wherein the support structure is further defined as two inverted and laterally spaced apart u-shaped tubular members extending upwardly from the two air tanks, such that the compressor is disposed substantially within a volume defined by the u-shaped tubular members and the air tanks.

13. The air compressor of claim 10 wherein a center of the handle is positioned in a vertical plane when the air compressor assembly is positioned in the transport position, the vertical plane extending substantially through a center of gravity ($CG_{ACP}$) of the air compressor assembly.

14. The air compressor of claim 13 wherein the handle is positioned such that when the air compressor assembly is positioned in the transport position and a user is transporting the air compressor assembly, the handle is grasped by the hand of a user such that a wrist associated with the hand of the user is not positioned in a state of flexion.

15. The air compressor of claim 14 wherein the handle is positioned within about 10 inches of the lateral side of the user when the air compressor assembly is positioned in the transport position, the handle is grasped by the hand of the user and the air compressor assembly is being transported by the user.

16. The air compressor of claim 15 wherein the handle is positioned within about 3 inches to about 7 inches of the lateral side of the user when the air compressor assembly is positioned in the transport position, the handle grasped by the hand of the user and the air compressor assembly is being transported by the user.

17. An air compressor comprising:

two laterally spaced apart air tanks having longitudinal axes in parallel with each other;

a compressor disposed between the two air tanks and in fluid connection with each of the air tanks;

two inverted u-shaped tubular members extending upwardly from the two air tanks, the two u-shaped tubular members being laterally spaced apart such that the compressor is disposed substantially within a volume defined by the u-shaped tubular members and the air tanks;

a handle projecting outwardly in a horizontal direction away from the compressor and extending between the two u-shaped tubular members in a direction generally parallel to the longitudinal axes of the two air tanks, the handle configured to be grasped by a hand of a user so that the air compressor can be rotated about a horizontal axis between an operating position and a hand-carried transport position; and at least one rubber member affixed to an outwardly facing surface of the air tank disposed opposite the handle, such that the rubber member prevents slippage of the air compressor assembly away from the user when the compressor assembly is moved between the operating position and the transport position.

* * * * *

UNITED STATES PATENT AND TRADEMARK OFFICE

CERTIFICATE OF CORRECTION

PATENT NO. : 6,991,437 B2
APPLICATION NO. : 11/053033
DATED : January 31, 2006
INVENTOR(S) : Richard Cherry et al.

It is certified that error appears in the above-identified patent and that said Letters Patent is hereby corrected as shown below:

Title Page,
Item [63] Related U.S. Application Data, lines 3 and 4, following "application No. 10/154,416, filed on May 23, 2002," "now abandoned" should be -- now Pat. No. 6,942,464 --.

Signed and Sealed this

Twelfth Day of June, 2007

JON W. DUDAS
*Director of the United States Patent and Trademark Office*